US007710335B2

(12) United States Patent
Yegin et al.

(10) Patent No.: US 7,710,335 B2
(45) Date of Patent: May 4, 2010

(54) DUAL BAND LOOP ANTENNA

(75) Inventors: Korkut Yegin, Grand Blanc, MI (US); Daniel G. Morris, Ovid, MI (US); Elias H. Ghafari, Rochester Hills, MI (US); Randall J. Snoeyink, Clarkson, MI (US); William R. Livengood, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 336 days.

(21) Appl. No.: 10/849,330

(22) Filed: May 19, 2004

(65) Prior Publication Data

US 2005/0259017 A1 Nov. 24, 2005

(51) Int. Cl.
*H01Q 21/00* (2006.01)

(52) U.S. Cl. ..... 343/728; 343/711; 343/713; 343/741

(58) Field of Classification Search ..... 343/702, 343/725, 728, 745, 749, 850, 711–713, 724, 343/729, 764, 866, 741, 744
See application file for complete search history.

(56) References Cited

U.S. PATENT DOCUMENTS

| | | | | | |
|---|---|---|---|---|---|
| 2,155,955 | A * | 4/1939 | Peterson | 343/733 |
| 5,300,936 | A * | 4/1994 | Izadian | 343/700 MS |
| 5,481,271 | A * | 1/1996 | Hai et al. | 343/749 |
| 5,537,123 | A * | 7/1996 | Mandai et al. | 343/700 MS |
| 5,949,383 | A * | 9/1999 | Hayes et al. | 343/795 |
| 5,982,330 | A * | 11/1999 | Koyanagi et al. | 343/702 |
| 6,087,990 | A * | 7/2000 | Thill et al. | 343/700 MS |
| 6,100,847 | A * | 8/2000 | Sointula | 343/702 |
| 6,184,833 | B1 * | 2/2001 | Tran | 343/700 MS |
| 6,191,747 | B1 * | 2/2001 | Cosenza | 343/749 |
| 6,329,954 | B1 | 12/2001 | Fuchs et al. | 343/725 |
| 6,456,246 | B2 * | 9/2002 | Saito | 343/702 |
| 6,590,541 | B1 | 7/2003 | Schultze | 343/741 |
| 6,664,932 | B2 * | 12/2003 | Sabet et al. | 343/770 |
| 6,683,570 | B2 * | 1/2004 | Skladany et al. | 343/700 MS |
| 6,897,812 | B2 * | 5/2005 | Huang | 343/700 MS |
| 6,930,641 | B2 * | 8/2005 | Ohara et al. | 343/702 |
| 6,931,928 | B2 * | 8/2005 | Hashimoto et al. | 73/514.33 |
| 6,943,746 | B2 * | 9/2005 | Talvitie et al. | 343/767 |
| 2002/0080088 | A1 | 6/2002 | Boyle | 343/895 |
| 2003/0189519 | A1 | 10/2003 | Rutfors et al. | 343/702 |

FOREIGN PATENT DOCUMENTS

| | | |
|---|---|---|
| EP | 1237224 | 9/2002 |
| EP | 1280231 | 1/2003 |

OTHER PUBLICATIONS

EP 05 07 6081, European Search Report dated Aug. 11, 2005.

* cited by examiner

*Primary Examiner*—Douglas W Owens
*Assistant Examiner*—Jimmy T Vu
(74) *Attorney, Agent, or Firm*—Jimmy L. Funke

(57) ABSTRACT

An antenna assembly is disclosed. The antenna assembly includes a dual band vertical loop wire antenna extending from a printed circuit board positioned over a ground plane, wherein the wire antenna includes: at least one coiled section, at least one straight wire section, and at least one feeding post section.

14 Claims, 4 Drawing Sheets

DUAL BAND LOOP ANTENNA

TECHNICAL FIELD

The present invention generally relates to antenna assemblies and, more particularly, to a dual band loop antenna.

BACKGROUND OF THE INVENTION

Automotive vehicles are commonly equipped with dual-band personal communication systems (PCS) and digital/analog mobile phone service (AMPS) antennas. Such antennas have a height, for example, of at least 70 mm, and are implemented for cellular phone usage. Typically, these antennas are mounted exterior to the vehicle to achieve improved antenna performance and reduced radio frequency (RF) emissions to the inside of the vehicle. In many circumstances, height of the antenna may not be reduced because antenna performance may be compromised.

Due to high efficiency and ease of construction characteristics, helical wire antennas remain the first choice for many cellular antenna designers. For wire antennas, the optimum operation corresponds to $\lambda/4$ wavelength. The height, which is approximately 75-80 mm, is very close to $\lambda/4$ of the operation wavelength at the cellular phone lower frequency band (e.g. AMPS). This height may be further reduced using a normal-mode helical antenna. The height may be reduced to as little as 65 mm, however, a height reduction less than 65 mm may degrade the overall performance of the antenna.

Other known cellular antennas include a planar inverted circular/rectangular patch antenna having a reduced height, for example, of at least 30 mm. Additionally, the inverted path antenna has a higher linear gain. However, the diameter/width of antenna is undesirably increased to be at least 115 mm, and, are typically difficult to include dual band applications.

When antennas having large dimension width, but more often, height, are mounted on the exterior of the vehicle, the antenna becomes very noticeable, and often, unpleasant for vehicle users while introducing manufacturing difficulties for the OEMs. Accordingly, it is therefore desirable to provide an improved antenna assembly that is compact, provides adequate antenna performance, and offers multi-band capabilities.

SUMMARY OF THE INVENTION

The present invention relates to an antenna assembly. Accordingly, one embodiment of the invention is directed to an antenna assembly including a dual band vertical loop wire antenna extending from a printed circuit board positioned over a ground plane. The wire antenna includes at least one coiled section, at least one straight wire section, and at least one feeding post section.

BRIEF DESCRIPTION OF THE DRAWINGS

The present invention will now be described, by way of example, with reference to the accompanying drawings, in which.

DESCRIPTION OF THE PREFERRED EMBODIMENT

Referring generally to FIGS. 1A-4, the above described disadvantages are overcome and a number of advantages are realized by a dual band loop antenna assembly, which is seen generally at 10, 100, 200, and 300. Each antenna assembly 10, 100, 200, 300 is a low-profile dual band antenna that accommodates operation between the 824-849 MHz band for AMPS uplink, the 869-894 MHz band for AMPS downlink, the 1850-1910 MHz band for PCS uplink, and the 1930-1990 MHz band for PCS downlink.

Figure 1A:
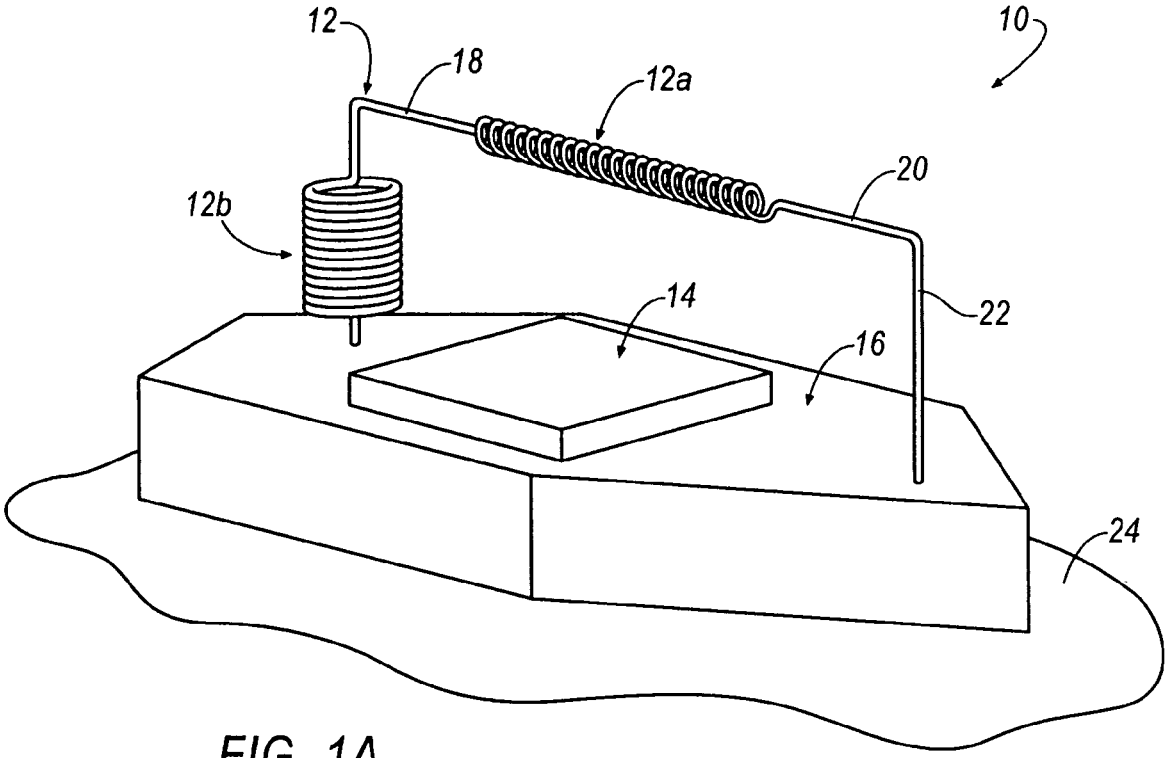
FIG. 1A illustrates a perspective view of a dual band loop antenna according to one embodiment of the invention.
Figure 1B:
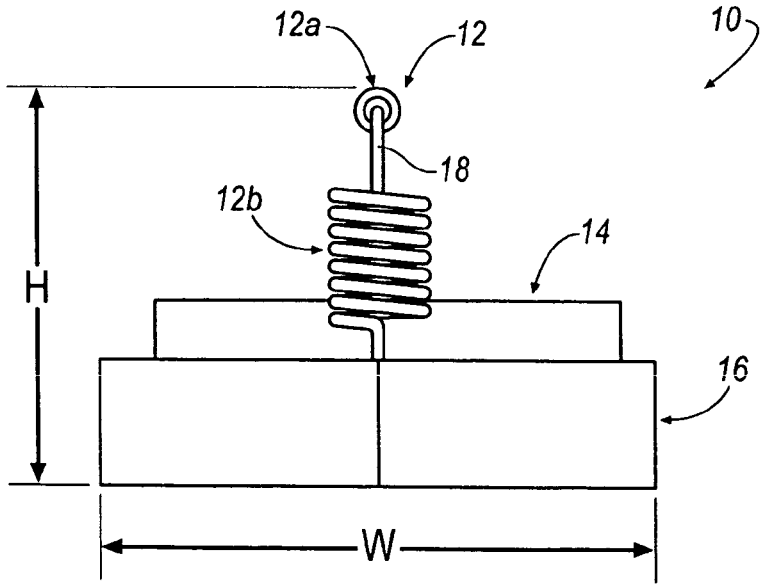
FIG. 1B illustrates a front view of the dual band loop antenna according to FIG. 1A.
Figure 1C:
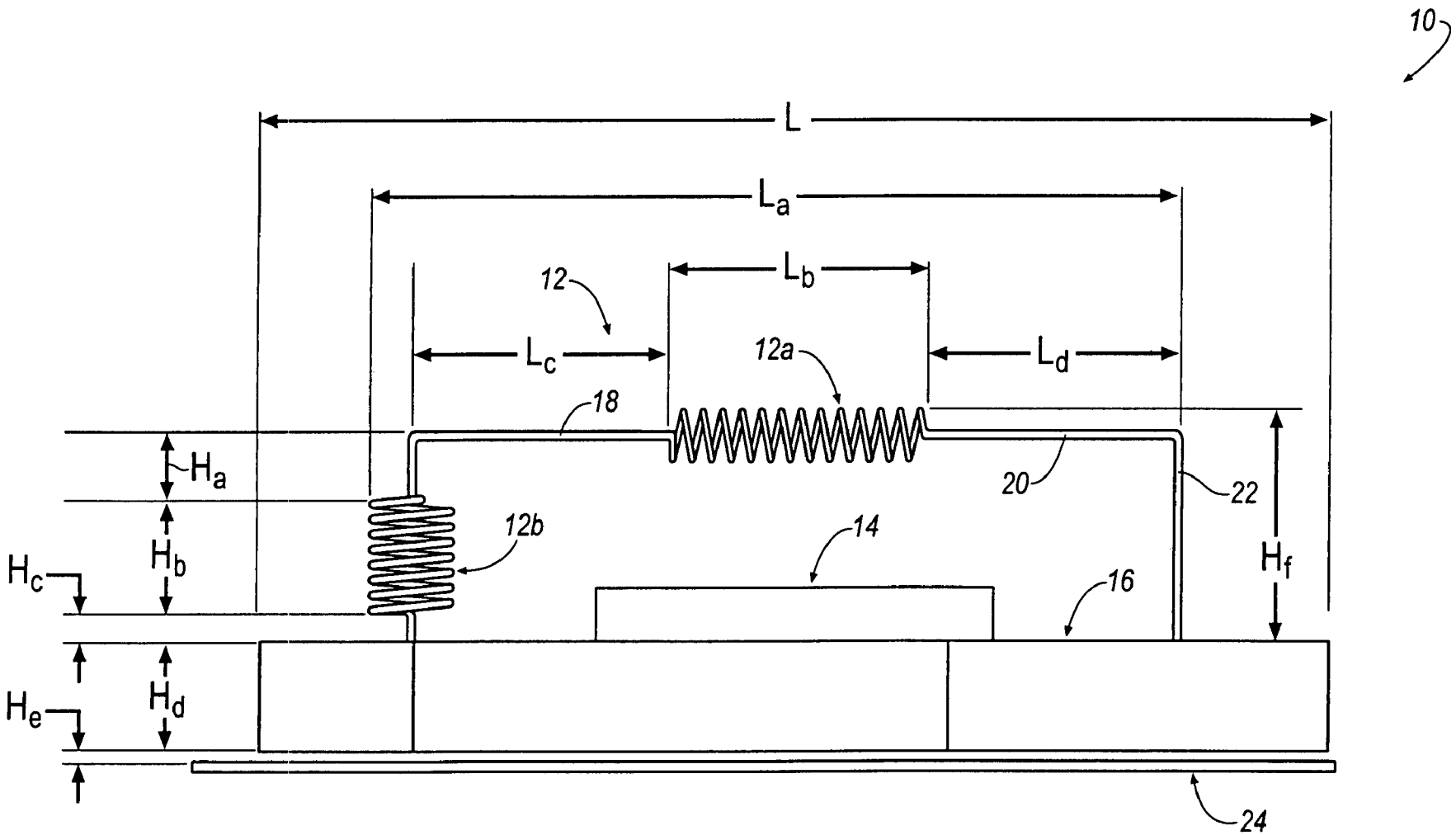
FIG. 1C illustrates a side view of the dual band loop antenna according to FIG. 1A.

Referring initially to FIGS. 1A-1C, the antenna assembly 10 includes at least one radiating element, such as, for example, a PCS/AMPS wire antenna 12, a patch antenna 14, and associated immediate active circuitry (not shown) within a printed circuit board (PCB) 16. The patch antenna may provide a combinational antenna assembly if global positioning signals (GPS), satellite digital audio radio system (SDARS) signals, or the like, are to be received. Functionally, antennas, such as the patch antenna 14, are receiving-only antennas that typically encounter weak satellite signal reception (i.e. by the time the satellite signal reaches the earth's surface, the received signal is weak). To compensate for the weakened signal reception, the antennas typically employ a known active microwave circuit, such as a low noise amplifier (LNA) that is located inside the PCB 16, to amplify the received weak signal to a much stronger level so that it can be further processed with the receiver/navigation system. Wire antennas 12, which are employed for analog and digital telephones bands PCS/AMPS applications, on the other hand, are used for both earth-based-transmitting (i.e. uplink frequencies) and earth-based-receiving (i.e. downlink frequencies) purposes, and therefore do not need an active microwave circuit for immediate amplification. At their transmitting mode, PCS/AMPS antennas are required to emit low electromagnetic energy to the people inside the vehicle so as not to cause any harm to living tissues. To comply with the specific absorption rate (SAR) standards determined by the Federal Communications Commission (FCC), the antenna assembly 10 is mounted exterior to the vehicle, such as the exterior roof 24 of the vehicle, which also acts as the ground plane 24 (FIG. 1A), so that radiation to the interior cabin of the vehicle is minimized.

Referring now to FIG. 1A, the antenna assembly 10 includes a single arm vertical half wavelength ($\lambda/2$) dual band loop antenna. The wire antenna 12 comprises first and second coiled sections 12*a*, 12*b*, straight sections 18, 20, and a feeding post section 22 extending from the straight section 20. As illustrated, the first coiled section 12*a* is located between the straight sections 18, 20, and is positioned over the patch antenna 14 and printed circuit board 16. The second coiled section 12*b* is generally perpendicular to and intermediately located between the printed circuit board 16 and the straight section 18. The feeding structure is located where the feed post 22 meets the printed circuit board 16 and the ground point is located where the second coiled section 12*b* meets the PCB 16. The feeding post 22 may also include a greater diameter than that of the wire antenna 12 to provide improved impedance matching.

As seen in FIG. 1C, the wire antenna 12 is defined by an overall length, $L_a$, and an overall height, $H_f$. The first coiled section 12*a*, and straight sections 18 and 20 are defined by lengths, $L_b$, $L_c$, and $L_d$, respectively. The second coiled section 12*b* is defined by a height, $H_b$, and is spaced from the straight section 18 and PCB 16 by heights, $H_b$ and $H_c$, respectively. The PCB 16 is spaced from the ground plane 24 by a height, $H_e$. The lengths, $L_a$, $L_b$, $L_c$, and $L_d$, may be any desirable length, and the heights, $H_a$, $H_b$, $H_c$, $H_d$, $H_e$, $H_f$, may be any desirable height, such that an overall length, L, width, W (FIG. 1B), and height, H, provides a compact structure that is less visible when mounted on the vehicle's outer ground plane, such as the roof 24.

Accordingly, the utilization of the coiled sections 12*a*, 12*b* provides dual-band operation and the feeding post section 22 provides impedance matching to reduce the overall height, H, of the antenna assembly 10 from the ground plane 24. The overall height, H, of the antenna assembly 10 may be any desirable minimized height, and is generally determined by the overall wire antenna height, $H_f$, of the PCS/AMPS antenna 12. According to one embodiment of the invention, the overall wire antenna height, $H_f$, is approximately 15 mm and the overall height, H, of the antenna assembly is approximately 23 mm. Additionally, the height, H, of the antenna may be further reduced by providing material loading to antenna assembly 10. The material loading provides a longer electrical path so that the antenna assembly will be electrically higher than its physical height, thereby reducing the bandwidth of the antenna assembly.

The coiled windings results in an increased wire antenna length, $L_a$, that corresponds to a lower-frequency, such as for AMPS or PCS, while also reducing the overall length, L, thereby providing a shorter antenna for higher frequencies, to allow dual band operations. According to one embodiment of the invention, the overall wire antenna length, $L_a$, is approximately 52.5 mm and the overall length, L, of the antenna assembly is approximately 70 mm. Because only one branch or section, which is defined by the wire antenna 12 is implemented, the overall width, W, is reduced, such as, for example, to as little as approximately 30 mm.

In operation, the ground plane 24 introduces an image of the antenna so that the total length becomes a one wavelength (1.0λ) loop antenna (i.e. theoretically, the wire antenna 12 and posts raised from ground plane constitute a λ/2 long loop antenna). Essentially, the ground plane 24, or any other type of metallization, mirrors the antenna such that the wire antenna 12 resonates over the ground plane, causing two antennas to radiate into space and the ground plane 24, thereby causing the λ/2 long loop antenna to appears as a 1.0λ long loop antenna. Such loop antennas that have a circumference on the order of one wavelength include radiation patterns both at vertical and horizontal planes (i.e. the loop antenna has two E-planes and one H-plane). Essentially, the loop plane has a loop space that is the vertical plane for the electric field.

Figure 2A:
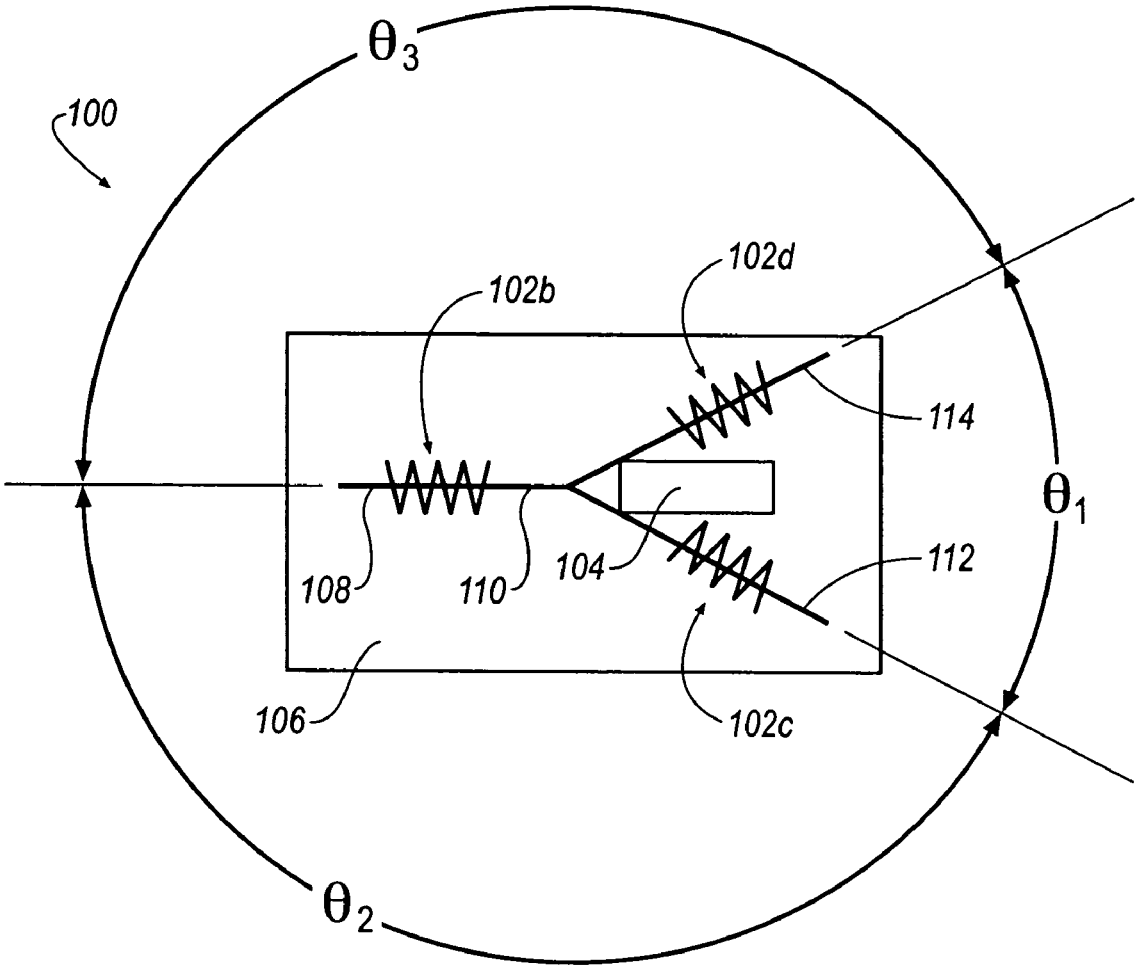
FIG. 2A illustrates a top view of a dual band loop antenna according to another embodiment of the invention.
Figure 2B:
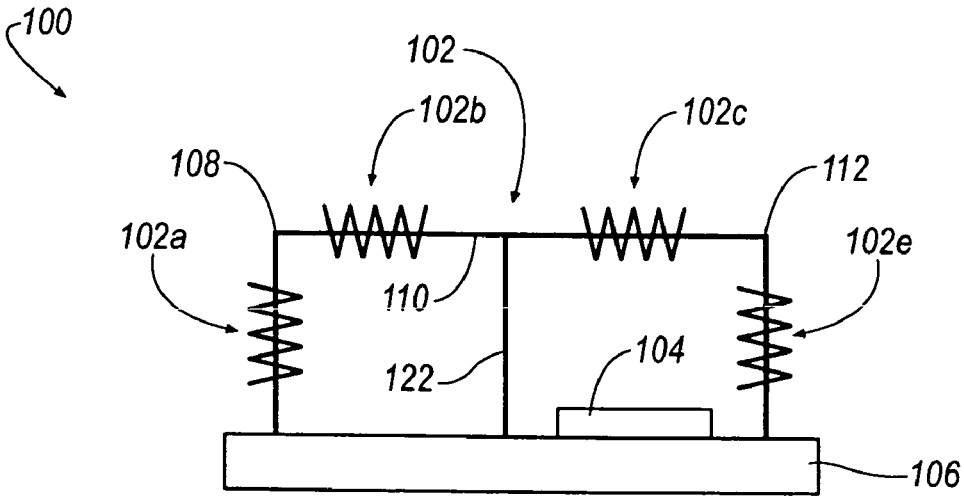
FIG. 2B illustrates a side view of a dual band loop antenna according to another embodiment of the invention.

Referring now to FIGS. 2A and 2B, another embodiment of the invention is directed to an antenna assembly 100 that includes at least one radiating element, such as, for example, a PCS/AMPS wire antenna 102, a patch antenna 104, and associated immediate active circuitry (not shown) within a PCB 106. The antenna assembly 100 includes a three-branch or Y-shaped vertical λ/2 loop antenna to provide an optimum circular pattern. As illustrated, the antenna assembly 100 comprises six coiled sections 102*a*-102*e*, straight sections 108, 110, 112, 114, and a central feeding post section 122 extending from the straight section 110 into the PCB 106. Although only 5 coiled sections are visually accounted for in FIGS. 2A and 2B, the sixth coiled section extends from the straight section 114 perpendicularly towards the PCB 106, and the visible coiled sections 102*a* and 102*e* are shown extending in a generally perpendicular configuration with respect to the ground plane 24. The remaining three coiled sections 102*b*-102*d* are shown generally parallel to the ground plane 24, which are hereinafter referred to as the 'top coiled sections.'

The top coiled sections 102*b*-102*d* and associated straight sections 108-114 of the Y-shaped antenna assembly 100 are positioned at angles, $\theta_1$-$\theta_3$, that determine the overall shape of the antenna assembly 100. According to one embodiment of the invention, angles $\theta_1$-$\theta_3$ may each be approximately equal to 120°, thereby complementing each other in symmetrical fashion. However, for packaging considerations, the branches may not be separated by 120°. For example, two arms may be separated by 60° at $\theta_1$, as $\theta_2$, $\theta_3$ may separate the remaining branch by 150° each to arrive at a symmetrical antenna assembly 100 when viewed from the X-Y plane.

In this embodiment, the vertical polarization pattern is nearly uniform in the azimuth plane because interaction between the branches is maintained as a result of the antenna assembly 100 being symmetrical in the X-Y plane (FIG. 2A). With three branches extending in a horizontal plane and each elevated from ground at approximately 0.1λ, the radiation pattern in azimuth becomes almost uniform, which thereby achieves relatively high gains due to increased length of the wire antenna 102. However, by including additional branches beyond the illustrated total of three branches, uniformity of the vertical polarization pattern may be lost. For example, when four, five, or six branches are included in the design, ripples in the signal may occur.

Figure 3:
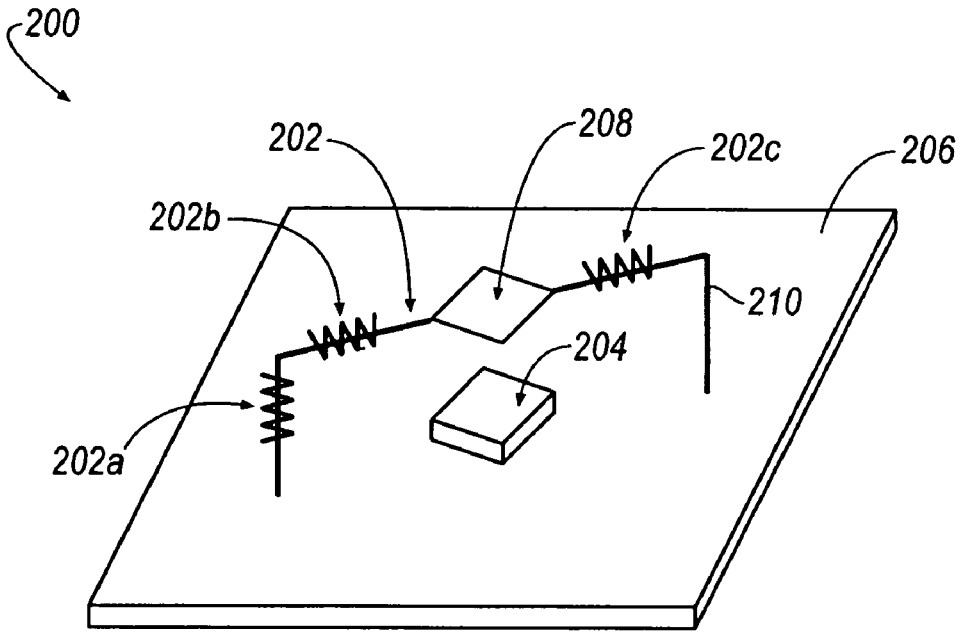
FIG. 3 illustrates a perspective view of a dual band loop antenna according to another embodiment of the invention.
Figure 4:
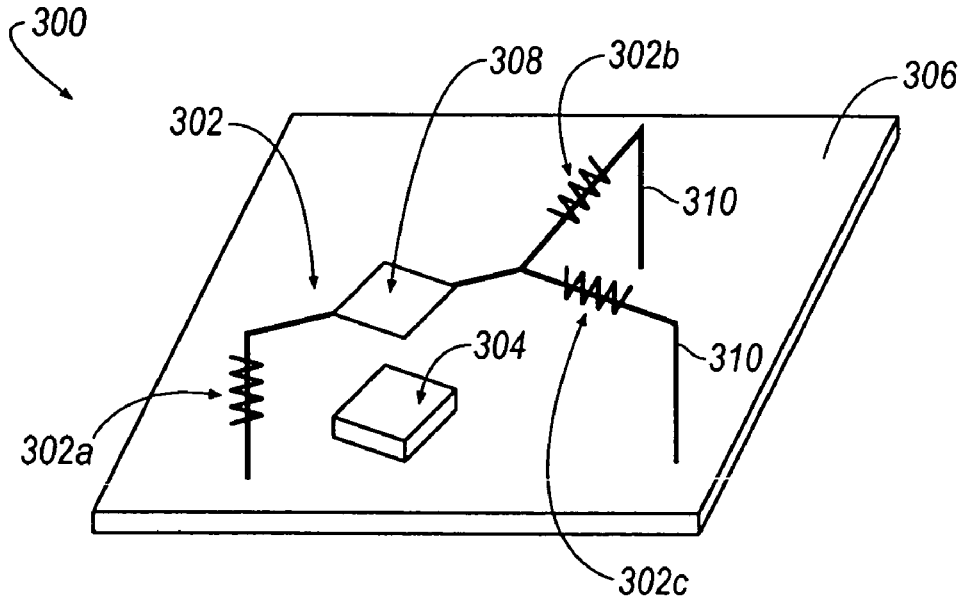
FIG. 4 illustrates a perspective view of a dual band loop antenna according to another embodiment of the invention.

As seen in FIGS. 3 and 4, another embodiment of the invention is directed to antenna assemblies 200, 300 that includes at least one radiating element, such as, for example, a PCS/AMPS wire antenna 202, 302, a patch antenna 204, 304, and associated immediate active circuitry (not shown) within a PCB 206, 306. As illustrated, the antenna assemblies 200, 300 respectively include straight wire sections and coiled sections 202*a*-202*c*, 302*a*-302*c*, and a feeding post 210, 310. In this embodiment of the invention, each antenna assembly 200, 300 includes a diamond-shaped wire section 208, 308 integrated with the vertical λ/2 loop antenna to provide improved impedance matching. Although shapes other than a diamond may be used, the diamond-shaped wire section 208, 308 provides an inductive load that neutralizes the capacitive impedance of the antenna assembly 200, 300. In operation, the diamond-shaped wire section 208, 308 is located over the antenna 204, 304 in a generally parallel configuration with respect to the PCB 206, 306 such that additional height is not introduced to the antenna assembly 200, 300. If additional impedance matching is needed to provide optimum performance, discrete components may be introduced at the terminals of the antenna.

As a result of the present invention, a smaller dual band antenna assembly 10, 100, 200, 300 may be used rather than high-profile dual band antenna assemblies. High profile dual band antennas for purposes of comparison, may be greater than or equal to approximately 65 mm. Additionally, the patch antenna 14, 104, 204, 304 may provide a combinational antenna assembly that permits reception of other signals, such as GPS, SDARS, or the like. Thus, the present antenna assembly is compact, provides adequate antenna performance, and offers multi-band, such as dual-band capabilities. As a result, because the antenna is a compact design, overall packaging of the antenna assembly is reduced and a more aesthetically pleasing antenna when mounted on the exterior of a vehicle is achieved.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. An antenna assembly comprising:

a dual band vertical loop wire antenna extending from a printed circuit board positioned over and capacitively coupled to a ground plane, wherein the wire antenna forms a single serially connected structure including at least one coiled section, at least one straight wire section, and at least one feeding post section, and where at least two of said sections of the wire antenna terminate at said printed circuit board to provide a feed and ground path therewith, and wherein the multi-branch antenna is a Y-shaped antenna, wherein the branches of the Y-shaped antenna are positioned in a symmetrical fashion at angles that are each approximately equal to 120°.

2. An antenna assembly, comprising:

a dual band vertical loop wire antenna extending from a printed circuit board positioned over a ground plane, wherein the wire antenna includes:

a single structure including serially arranged, at least one coiled section, at least one straight wire section, and at least one feeding post section, wherein the wire antenna accommodates operation between the 824-849 MHz band for AMPS uplink, the 869-894 MHz band for AMPS downlink, the 1850-1910 MHz band for PCS uplink, and the 1930-1990 MHz band for PCS downlink; and wherein the wire antenna is a multi-branch vertical half wavelength dual band loop antenna.

3. The antenna assembly according to claim 2, wherein the multi-branch antenna is a Y-shaped antenna.

4. The antenna assembly according to claim 3, wherein the branches of the Y-shaped antenna are positioned in a symmetrical fashion at angles that are each approximately equal to 120°.

5. An antenna assembly, comprising:

a dual band vertical loop wire antenna extending from a printed circuit board positioned over a ground plane, wherein the wire antenna includes:

a single structure including serially arranged at least one coiled section, at least one straight wire section, and at least one feeding post section, and a diamond-shaped wire section integrated with the wire antenna to provide improved impedance matching; and a patch antenna and a low noise amplifier within the printed circuit board.

6. The antenna assembly according to claim 5, wherein the patch antenna receives global positioning signals and satellite digital audio radio system signals.

7. The antenna assembly according to claim 5, wherein the ground plane is a metalized vehicular roof.

8. The antenna assembly according to claim 5, wherein the at least one of the coiled sections is substantially perpendicular to the ground plane and at least one of the coiled sections is substantially parallel to the ground plane.

9. An antenna assembly, comprising:

a dual band vertical loop wire antenna extending from a printed circuit board positioned over a ground plane, wherein the wire antenna includes:

a single structure including serially arranged at least one coiled section, at least one straight wire section, and at least one feeding post section, and a diamond-shaped wire section integrated with the wire antenna to provide improved impedance matching;

wherein the wire antenna is a multi-branch vertical half wavelength dual band loop antenna.

10. The antenna assembly according to claim 9, wherein the multi-branch antenna is a Y-shaped antenna.

11. The antenna assembly according to claim 10, wherein the branches of the Y-shaped antenna are positioned in a symmetrical fashion at angles that are each approximately equal to 120°.

12. An antenna assembly, comprising:

a dual band vertical loop wire antenna extending from a printed circuit board positioned over a ground plane, wherein the wire antenna includes:

a single structure including serially arranged at least one coiled section, at least one straight wire section, and at least one feeding post section, and wherein the height of the antenna assembly is less than 65 mm; and wherein the wire antenna is a multi-branch vertical half wavelength dual band loop antenna.

13. The antenna assembly according to claim 12, wherein the multi-branch antenna is a Y-shaped antenna.

14. The antenna assembly according to claim 13, wherein the branches of the Y-shaped antenna are positioned in a symmetrical fashion at angles that are each approximately equal to 120°.

* * * * *